US011231218B2

(12) United States Patent
Knatt

(10) Patent No.: US 11,231,218 B2
(45) Date of Patent: Jan. 25, 2022

(54) ICE MACHINE WITH A DUAL-CIRCUIT EVAPORATOR FOR HYDROCARBON REFRIGERANT

(71) Applicant: True Manufacturing Co., Inc., O'Fallon, MO (US)

(72) Inventor: Kevin Knatt, St. Louis, MO (US)

(73) Assignee: True Manufacturing Company, Inc., O'Fallon, MO (US)

( * ) Notice: Subject to any disclaimer, the term of this patent is extended or adjusted under 35 U.S.C. 154(b) by 0 days.

(21) Appl. No.: 16/864,346

(22) Filed: May 1, 2020

(65) Prior Publication Data

US 2020/0256605 A1 Aug. 13, 2020

Related U.S. Application Data

(63) Continuation of application No. 16/590,484, filed on Oct. 2, 2019, now Pat. No. 10,677,505, which is a (Continued)

(51) Int. Cl.
*F25C 1/25* (2018.01)
*F25C 1/12* (2006.01)

(Continued)

(52) U.S. Cl.
CPC ..... *F25C 1/25* (2018.01); *F25B 39/02* (2013.01); *F25B 47/022* (2013.01); *F25C 1/12* (2013.01);

(Continued)

(58) Field of Classification Search
CPC ..... F25C 1/12; F28D 1/0477; F25B 47/022; F25B 39/02; F25B 2339/023; F25B 2400/06; F28F 2210/10
See application file for complete search history.

(56) References Cited

U.S. PATENT DOCUMENTS 4,187,690 A 2/1980 Lindahl
4,332,137 A 6/1982 Hayes, Jr.

(Continued)

FOREIGN PATENT DOCUMENTS

EP 2 284 460 A1 2/2011
JP 2008209083 A 9/2008

OTHER PUBLICATIONS

Extended European Search Report dated Jun. 24, 2019 related to European Patent Application No. 16880020.9, 7 pages.

(Continued)

*Primary Examiner* — Henry T Crenshaw
(74) *Attorney, Agent, or Firm* — Stinson LLP

(57) ABSTRACT

An ice making machine having a refrigeration system designed for hydrocarbon (HC) refrigerants, and particularly propane (R-290), that includes dual independent refrigeration systems and a unique evaporator assembly comprising of a single freeze plate attached to two cooling circuits. The serpentines are designed in an advantageous pattern that promotes efficiency by ensuring the even bridging of ice during freezing and minimizing unwanted melting during harvest by providing an even distribution of the heat load. The charge limitations imposed with flammable refrigerants would otherwise prevent large capacity ice maker from being properly charged with a single circuit. The ice making machine includes a single water circuit and control system.

12 Claims, 5 Drawing Sheets

Related U.S. Application Data continuation of application No. 15/386,578, filed on Dec. 21, 2016, now Pat. No. 10,502,472.

(60) Provisional application No. 62/270,391, filed on Dec. 21, 2015.

(51) Int. Cl.

| | |
|---|---|
| ***F28D 1/047*** | (2006.01) |
| ***F25B 39/02*** | (2006.01) |
| ***F25B 47/02*** | (2006.01) |
| ***F25B 25/00*** | (2006.01) |
| ***F25B 40/00*** | (2006.01) |
| ***F25B 5/02*** | (2006.01) |
| ***F25B 6/02*** | (2006.01) |

(52) U.S. Cl.

CPC ..... *F28D 1/0477* (2013.01); *F25B 5/02* (2013.01); *F25B 6/02* (2013.01); *F25B 25/005* (2013.01); *F25B 40/00* (2013.01); *F25B 2339/023* (2013.01); *F25B 2400/06* (2013.01); *F25B 2400/12* (2013.01); *F25C 2600/04* (2013.01); *F28F 2210/10* (2013.01)

(56) References Cited

U.S. PATENT DOCUMENTS

| | | | | |
|---|---|---|---|---|
| 4,344,298 | A | 8/1982 | Biemiller | |
| 4,366,679 | A | 1/1983 | Van Steenburgh, Jr. | |
| 4,774,814 | A | 10/1988 | Yingst et al. | |
| 4,903,505 | A | 2/1990 | Sakai et al. | |
| 5,289,691 | A | 3/1994 | Schlosser et al. | |
| 5,606,869 | A | 3/1997 | Joo | |
| 5,653,114 | A * | 8/1997 | Newman | F25C 1/12 62/138 |
| 5,711,159 | A | 1/1998 | Whipple, III | |
| 5,934,364 | A * | 8/1999 | Chrysler | F25B 41/20 165/170 |
| 6,148,621 | A | 11/2000 | Byczynski et al. | |
| 6,161,396 | A * | 12/2000 | Allison | B23K 1/0012 62/347 |
| 6,886,349 | B1 * | 5/2005 | Curicuta | F25B 39/00 165/178 |
| 2003/0150227 | A1 | 8/2003 | Ross et al. | |
| 2006/0168970 | A1 | 8/2006 | Ross et al. | |
| 2007/0079627 | A1 | 4/2007 | Broadbent et al. | |
| 2007/0125120 | A1 | 6/2007 | Marques | |
| 2007/0157636 | A1 * | 7/2007 | Billman | F25C 5/10 62/73 |
| 2009/0211269 | A1 | 8/2009 | Gist et al. | |
| 2012/0060545 | A1 | 3/2012 | Rafalovich et al. | |
| 2013/0180268 | A1 | 7/2013 | Schlosser | |
| 2014/0138065 | A1 * | 5/2014 | Hotti | B21D 51/46 165/109.1 |
| 2014/0260375 | A1 | 9/2014 | Casserilla et al. | |
| 2015/0257548 | A1 | 9/2015 | Shapiro et al. | |
| 2016/0347598 | A1 | 12/2016 | Gannon et al. | |
| 2017/0276433 | A1 * | 9/2017 | Avila | B21D 11/10 |

OTHER PUBLICATIONS

International Search Report dated Apr. 11, 2017, related to Application No. PCT/US2016/067996, pp. 3.

Galyen, John Hydrocarbons Charge Up Refrigeration Innovations; Industry Likely to See Propane and Isobutane Products by 2010, www.danfoss.us, dated Sep. 9, 2009, pp. 1-3.

Notification of Reasons of Refusal and translation thereof, from counterpart JP Application No. 2021-119046, dated Oct. 11, 2021, 5 pages.

* cited by examiner

ICE MACHINE WITH A DUAL-CIRCUIT EVAPORATOR FOR HYDROCARBON REFRIGERANT

CROSS-REFERENCE TO RELATED APPLICATIONS

This application is a continuation of U.S. patent application Ser. No. 16/590,484, filed Oct. 2, 2019, which is a continuation of U.S. patent application Ser. No. 15/386,578, filed Dec. 21, 2016, which claims priority to, and incorporates by reference, U.S. provisional patent application Ser. No. 62/270,391, filed Dec. 21, 2015. Each of these applications is hereby incorporated in it is entirety for all purposes.

FIELD OF THE INVENTION

This invention relates generally to automatic ice making machines and, more specifically, to ice making machines using hydrocarbon refrigerants, such as propane, with a unique evaporator comprising of a single freeze plate attached to dual, independent refrigerant circuits that are designed in such a way as to ensure the even production of ice across the evaporator, thus allowing an increased ice production capacity within the allowable limit of system charge.

BACKGROUND

Ice making machines are employed in commercial and residential applications around the world. In domestic applications, ice makers are typically located in a freezer compartment. The resulting ice is usually of poor quality due to the trapping of air and impurities during the freezing process. In commercial applications, the ice makers typically freeze the ice upright, or vertically, in a manner that removes the impurities and creates pure, clear ice cubes. Among other references, U.S. Pat. No. 5,237,837 and Patent Publication No. 2010/0251746 are known and explain the embodiments of this process in detail. Commercial ice makers traditionally consist of a single ice making unit placed above an ice storage bin or automatic dispenser for accessing the ice. An ice level sensor signals when the bin or dispenser level is full, at which point, the ice making unit shuts down until the demand returns. As ice is dispensed or drawn from the bin, the ice falls away from the sensor and production resumes. U.S. Patent Publication No. 2008/0110186 is known and further explains this process in detail. Such machines have received wide acceptance and are particularly desirable for commercial installations such as restaurants, bars, motels and various beverage retailers having a high and continuous demand for fresh ice.

The refrigerant selection is a key element in the design of the ice maker. Ice machine evaporators operate at a medium to low temperature, having an optimum temperature ranging from −10° C. to −20° C. In September 1987, the Montreal Protocol banned the use of CFCs and began the phase-out of R-22. In its place, non-ozone depleting HFC refrigerants became the standard for the ice making application. In particular, R-404a, the pseudo-azeotropic blend of HFC-125, HFC-143a, and HFC-134a, provides a nearly stable temperature throughout the evaporation process, which is critical to producing a consistent ice slab across an evaporator. It is also non-flammable and, therefore, has no charge limitation placed on its use in commercial ice making machines. Higher ice capacities are possible by simply increasing the size of evaporator, compressor, and condensing unit, and in turn, increasing the amount refrigerant necessary to provide the proper charge for the system. Larger ice makers with self-contained condensing units could contain as much as 5 pounds (2,268 grams) of R-404a, and systems with remote condensing units could have over 10 pounds (4,536 grams) of R-404a, depending on the length of the connecting line sets.

Despite its optimum fit for the application, R-404a is receiving increasingly negative attention about its effect on the environment. GWP is the measure of given mass of greenhouse gas that is estimated to contribute global warming. Its relative scale is compared to that of Carbon Dioxide ($CO_2$) gas, which by convention has a GWP of one. R-404A is estimated to have a GWP of 3,922. Its direct release to the atmosphere is prohibited, however, the indirect release of refrigerant over the life of the equipment due to infinitesimal leakage can be nearly impossible to ascertain. An even greater impact exists with the indirect effect of the increased energy consumption required of equipment running on a reduced charge. In this case,—the impact is manifested with increase in carbon emissions released to the atmosphere during the creation of that additional energy. As such, the phase-out of HFC refrigerants has gained worldwide momentum. The European Union has taken measures to cut two-thirds of the emissions from fluorinated greenhouse gasses by 2030 by passing "F-gas Regulations," which took effect January 2015. The United States has followed suit by passing similar phase-out schedules to take effect as early as January 2016. Individual states have taken up the challenge as well. Specifically, the state of California proposed a rule in June, 2015, to ban all refrigerants with a GWP greater than 150 by January, 2021. To date, there are several alternative refrigerants which offer a potential drop-in replacement, such as R-407A or HFO blends like R-448, but none are below California's 150 GWP limit. Also, in particular for ice making machines, it is a requirement that any alternative working fluid have a negligible temperature glide in order to make ice evenly over the evaporating surface. The aforementioned HFO blends have a comparatively high temperature glide which make them unsuitable for the application. Ice maker manufactures will have no choice but to comply with the new laws taking shape, and ultimately, there will be an end to the use of HFCs and the proposed HFO alternative blends, and the ice making equipment will need to be completely redesigned.

With the aforementioned phase-out facing ice making manufacturers, the case for natural refrigerants has never been so prevalent. Propane (R-290) is a highly efficient and very environmentally friendly alternative having a GWP of only 2. It can essentially be dropped into existing systems without major modification; however, R-290 poses its own set of design challenges due to its flammability. The IEC has imposed a refrigerant charge limit of 150 grams in an effort to mitigate that risk. To take advantage of the benefits of R-290, manufacturers must develop techniques to limit the refrigerant charge of the system. One such technique is explained in U.S. Pat. No. 9,052,130, where a traditional fin and tube condenser has been replaced with an equivalent microchannel condenser with an internal volume from 100 to 250 milliliters. However, microchannel condensers are traditionally more expensive than fin and tube condensers, and with a volume of only 250 ml, there still remains a limit on the maximum ice capacity that can be obtained with such a condenser. Ice manufacturers have successfully made 500 pounds of ice per day with 150 grams of propane, but no solution exists for icemakers requiring greater capacity in a single system. Logically, to achieve the higher ice capacities, those skilled in the art would then be lead to employ multiple systems into one machine. U.S. Pat. No. 4,384,462 discloses a multiple compressor system that includes a plurality of evaporators and expansion devices that responds advantageously to increasing demand by cycling the systems according to that demand. Although not directly related to ice making machines, one could imagine a similar system for a commercial ice maker that would respond similarly to ice demand. However, the cost of multiple systems would make the product unprofitable. The evaporator, being made of a high thermal conductive material such as copper, is in some cases the most expensive component of an ice making machine. Outside of material cost, the fabrication, overhead costs, and any additional cost of performance coatings, such as Electroless Nickel, can sum to as much as a third of the entire ice making machine material cost. There could also be some significant performance-related drawbacks. A dual-evaporator system with cycling control would scale or corrode one evaporator more rapidly than the other resulting in more frequent failures of one side, effectively reducing the ice making capacity in half. The increased warranty costs for a hydrocarbon dual evaporator system drastically effect the business case and consume any potential profits as compared with the single HFC system evaporator standard of the day. Therefore, the current solutions presented for R-290 unfortunately offer little solution for larger ice making machines in a competitive market driven to reduce overall costs, especially with emerging manufacturers from around the world offering new competition.

A single R-290 system ice maker still offers the best solution, as it reduces the number of required components and conserves cost, but there must be a means to increase the ice capacity without significantly adding refrigerant charge. Although not specifically intended, one method that could be incorporated is the one described in U.S. Pat. No. 7,017,355, which uses two evaporator freeze plates with one refrigeration circuit. A rectangular cross-sectioned conduit is used between the two evaporator plates, increasing the efficiency of the system by recovering the heat traditionally lost on the opposite side of the refrigerant tubing. However, this method is unproven in the market and there is little evidence that flat conduit would last the duration of the icemakers service life due to the high probability of plate-tube separation. Surface imperfections in the flatness would cause pockets of air between the plate and tube, and ultimately lead to the build-up of ice between the two surfaces. Over repeated thermal cycling, the ice would expand to propagate behind the freeze plate, which lead to a reduced ice capacity and ultimately complete failure. On the contrary, ice making evaporators with round tubing attached to the freeze plate surface has been proven superior to the flat conduit by withstanding 10 or more years of thermal cycling without separation.

Thus, need remains for a single, commercial ice making machine capable of making more than 500 pounds of ice per day and that uses R-290 as its refrigerant. The solution demands that (1) the individual systems adhere to limitations set in place for hydrocarbons, (2) manufacturing costs be limited by reducing the number of expensive components and systems, and (3) a proven and reliable method to produce an evaporator can be repeated with good adhesion to the freeze plate. The present disclosure allows higher ice capacities in the event the charge limitations increase for R-290 single systems beyond 150 grams. Nonetheless, there will always be a charge limitation for use of flammable refrigerants for commercial equipment located and installed indoors. Those skilled in the art will have determined the maximum allowable ice capacity given the refrigerant limit, and in this case, the essence of the present disclosure in allowing still higher ice capacities would still apply.

SUMMARY OF THE INVENTION

Briefly, therefore, one embodiment of the invention is directed to an ice making assembly for forming ice using refrigerant capable of transitioning between liquid and gaseous states in which the assembly includes two refrigeration circuits with a single evaporator assembly. Each of the refrigeration circuits include a separate compressor, condenser, hot gas valve, thermal expansion device, and interconnecting lines. The refrigerant is preferably approximately 100 to 300 grams of hydrocarbon refrigerant. The evaporator assembly includes two refrigerant tubings, each formed in a serpentine shape and in fluid communication with one of the refrigeration circuits, and a freeze plate thermally coupled to the first and second refrigerant tubing. Preferably, the first and second refrigerant tubing are interleaved with one another as part of the evaporator assembly. The ice making assembly also includes a water system for supplying water to the freeze plate, the water system having a water pump, a water distributor above the freeze plate, a purge valve, a water inlet valve, and a water reservoir located below the freeze plate adapted to hold water. The water pump is in fluid communication with the reservoir and the water distributor in order to cycle water over the freeze plate.

The present invention provides higher ice capacities while operating safely within the design limitations of hydrocarbon refrigerants. Solving this and the other aforementioned problems, the present invention comprises a unique evaporator assembly, wherein a single freeze plate is attached to dual, independent hydrocarbon refrigeration systems. The disclosed invention conserves material cost as compared to a traditional dual system ice maker by employing a single evaporator, single water circulation system, and single microprocessor to monitor and control the efficient production of ice.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

DETAILED DESCRIPTION

Before any embodiments of the invention are explained in detail, it will be understood that the invention is not limited in its application to the details of construction and the arrangement of components set forth in the following description or illustrated in the following drawings. The invention is capable of other embodiments and of being practiced or of being carried out in various ways. Also, it will be understood that the phraseology and terminology used herein are for the purpose of description and should not be regarded as limiting. The use of "including," "comprising," or "having" and variations thereof is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an invention disclosed herein or its components to any one positional or spatial orientation.

Figure 1:
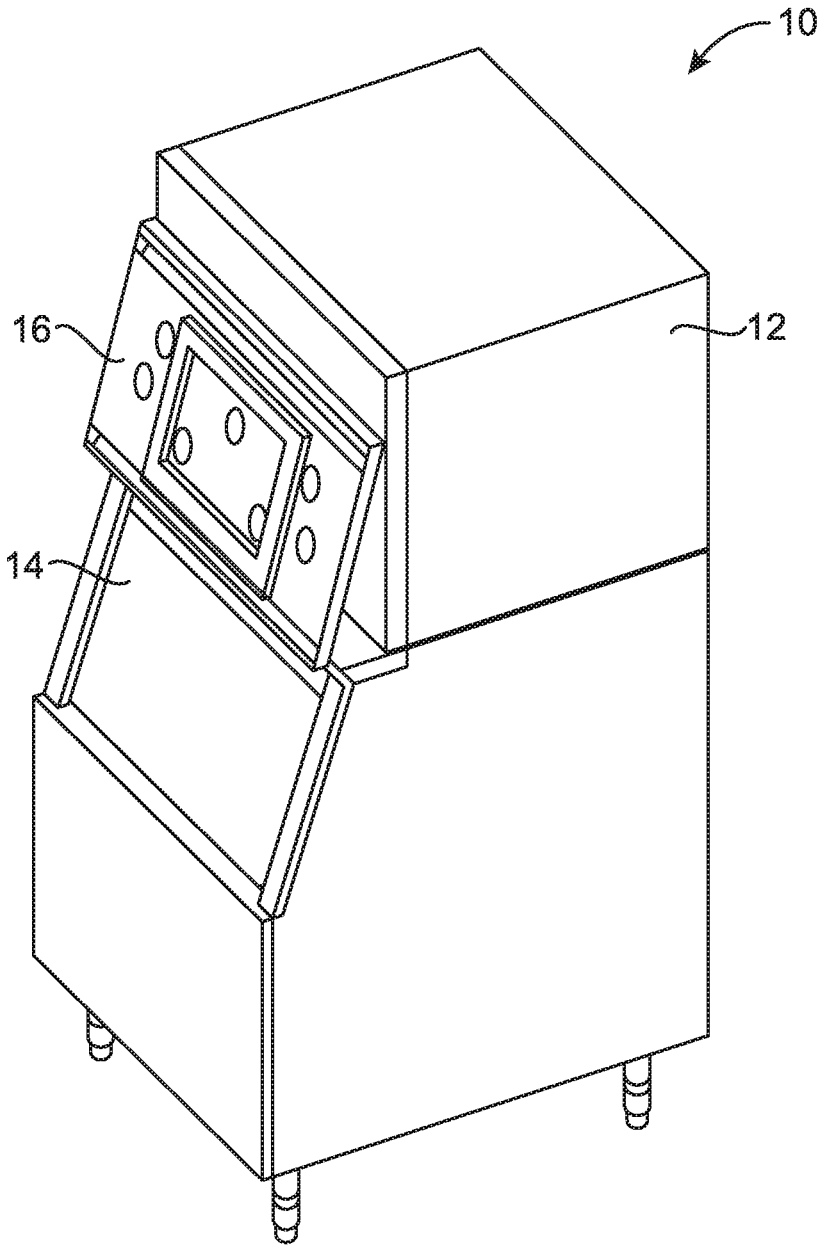
FIG. 1 is a perspective view of an ice maker.

FIG. 1 illustrates a conventional commercial ice maker 10 having an ice making assembly disposed inside of a cabinet 12 that may be mounted on top of an ice storage bin 14. The ice storage bin 14 may include a door 16 that can be opened to provide access to the ice stored therein. The ice maker 10 may have other convention components not described herein without departing from the scope of the invention.

Figure 2:
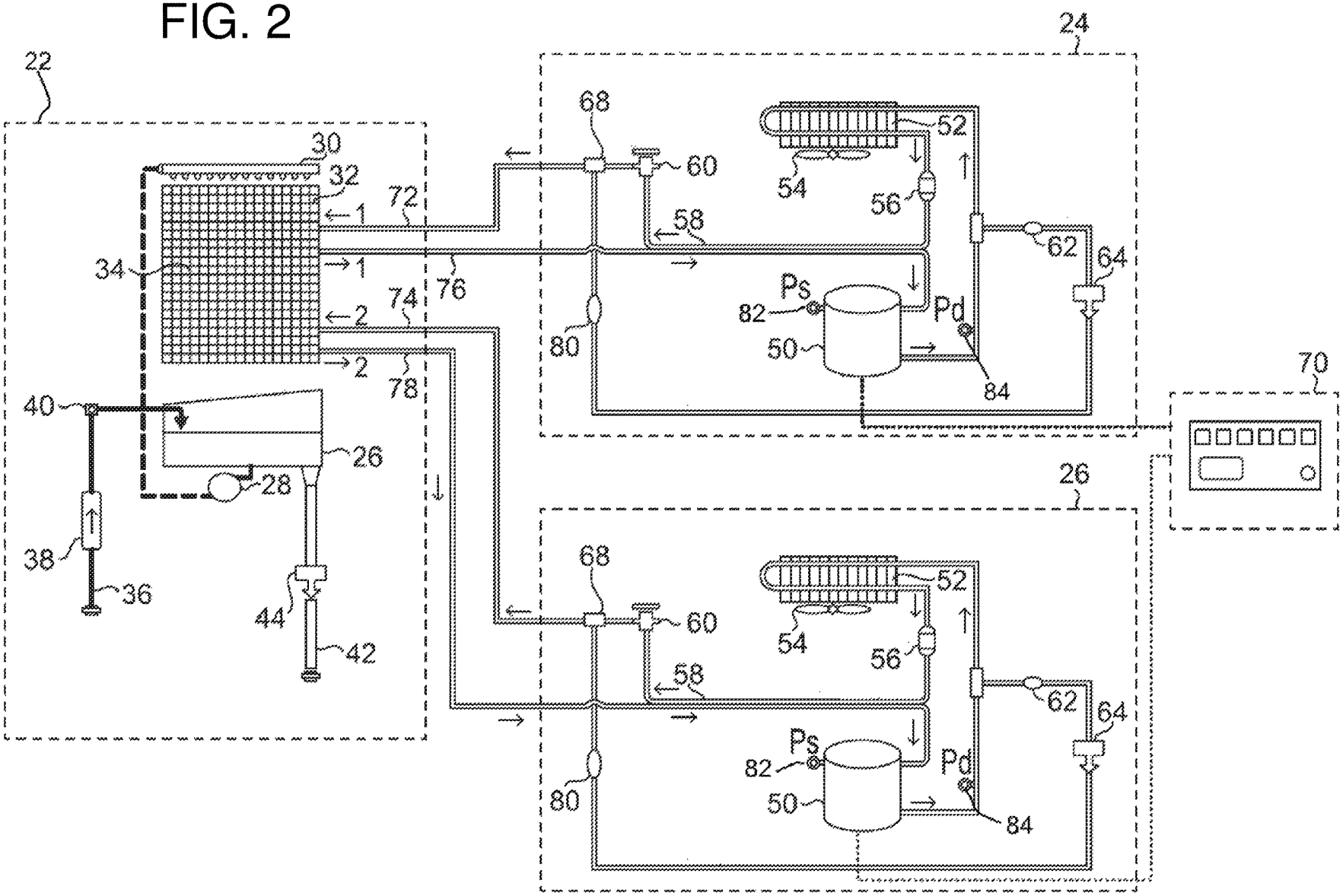
FIG. 2 is a schematic drawing of an ice making system according to one embodiment of the present invention, illustrating the dual refrigeration circuits attached to a single evaporator.

FIG. 2 illustrates certain principal components of one embodiment of an ice making assembly 20 having a water circuit 22 and two refrigeration circuits, 24 and 26. The refrigeration circuits may be formed with identical components and, therefore, such components will be described using like reference numbers. The water circuit 22 may include a water reservoir 26, water pump 28 circulating water to a water distribution manifold or tube 30 for distribution across an evaporator assembly 32. During operation of the ice making assembly 20, as water is pumped from water reservoir 26 by water pump 28 through a water line and out of distributor manifold or tube 30, the water impinges on the evaporator assembly 32, flows over the pockets of the freeze plate 34 and freezes into ice. The water reservoir 26 may be positioned below the evaporator assembly 32 to catch the water coming off of assembly 32 such that the water may be recirculated by water pump 28.

The water circuit 22 may further include water supply line 36, water filter 38 and water inlet valve 40 disposed thereon for filling the water reservoir 26 with water from a water supply, wherein some or all of the supplied water may be frozen into ice. The water reservoir 26 may include some form of a water level sensor, such as a float or conductivity meter, as is known in the art. The water circuit 22 may further include a water purge line 42 and purge valve 44 disposed thereon. Water and/or any contaminants remaining in reservoir 26 after ice has been formed may be purged via purge valve 44 through the purge line 42.

Each of the refrigeration circuits 24 and 26 may include a compressor 50, condenser 52 for condensing compressed refrigerant vapor discharged from the compressor 50, a condensing fan 54 positioned to blow a gaseous cooling medium across condenser 52, a drier 56, a heat exchanger 58, thermal expansion device 60 for lowering the temperature and pressure of the refrigerant, a strainer 62, and hot gas bypass valve 64. As described more fully elsewhere herein, a form of refrigerant cycles through these components.

Thermal expansion device 60 may include, but is not limited to, a capillary tube, a thermostatic expansion valve or an electronic expansion valve. In certain embodiments, where thermal expansion device 60 is a thermostatic expansion valve or an electronic expansion valve, water circuit 22 may also include a temperature sensing bulb placed at the outlet of the evaporator assembly 32 to control thermal expansion device 60. In other embodiments, where thermal expansion device 60 is an electronic expansion valve, water circuit 22 may also include a pressure sensor (not shown) placed at the outlet of the evaporator assembly 32 to control thermal expansion device 60 as is known in the art.

The refrigeration circuits 24 and 26, as well as the water circuit 22 may be controlled by controller 70 for the startup, freezing, and harvesting cycles through a series of relays. The controller 70 may include a processor along with processor-readable medium storing code representing instructions to cause processor to perform a process. The processor may be, for example, a commercially available microprocessor, an application-specific integrated circuit (ASIC) or a combination of ASICs, which are designed to achieve one or more specific functions, or enable one or more specific devices or applications. In yet another embodiment, controller 70 may be an analog or digital circuit, or a combination of multiple circuits. Controller 70 may also include one or more memory components (not shown) for storing data in a form retrievable by controller 70. Controller 70 can store data in or retrieve data from the one or more memory components. Controller 70 may also include a timer for measuring elapsed time. The timer may be implemented via hardware and/or software on or in controller 70 and/or in the processor in any manner known in the art without departing from the scope of the invention.

Having described each of the individual components of one embodiment of refrigeration circuits 24 and 26, the manner in which the components interact and operate in various embodiments may now be described in reference again to FIG. 2. Initially, each of the refrigeration circuits is charged with a hydrocarbon refrigerant, such as propane R290, to a certain charging limit, for example, between 100 and 300 grams, or preferably up to about 150 grams. During operation of the refrigeration circuits, each compressor 50 receives low-pressure, substantially gaseous refrigerant from evaporator assembly 32 through an associated line (line 76 for the first refrigeration circuit 24 and line 78 for the second refrigeration circuit 26). The compressor 50 pressurizes the refrigerant, and discharges high-pressure, substantially gaseous refrigerant to condenser 52. The difference in pressure between suction side of the compressor 50 and the discharge side of the compressor 50 may be determined using two pressure sensors located on the suction and discharge lines, Ps 82 and Pd 84. In condenser 52, heat is removed from the refrigerant, causing the substantially gaseous refrigerant to condense into a substantially liquid refrigerant.

After exiting condenser 52, the high-pressure, substantially liquid refrigerant is routed through the drier 56 to remove moisture and, if the drier 56 includes a form of filter such as a mesh screen, to remove certain particulates in the liquid refrigerant. The refrigerant then passes through a heat exchanger 58, which uses the warm liquid refrigerant leaving the condenser 52 to heat the cold refrigerant vapor leaving the evaporator assembly 32, and into the thermal expansion device 60, which reduces the pressure of the substantially liquid refrigerant for introduction into evaporator assembly 32 through tee 68 via lines 72 and 74. As the low-pressure expanded refrigerant is passed through the tubing of evaporator assembly 32, the refrigerant absorbs heat from the tubes contained within evaporator assembly 32 and vaporizes as the refrigerant passes through the tubes, thus cooling evaporator 32. Low-pressure, substantially gaseous refrigerant is discharged from the outlet of evaporator assembly 32 through a suction line (line 76 for the first refrigeration circuit 24 and line 78 for the second refrigeration circuit 26), and is reintroduced into the inlet of each compressor 50.

Figure 3:
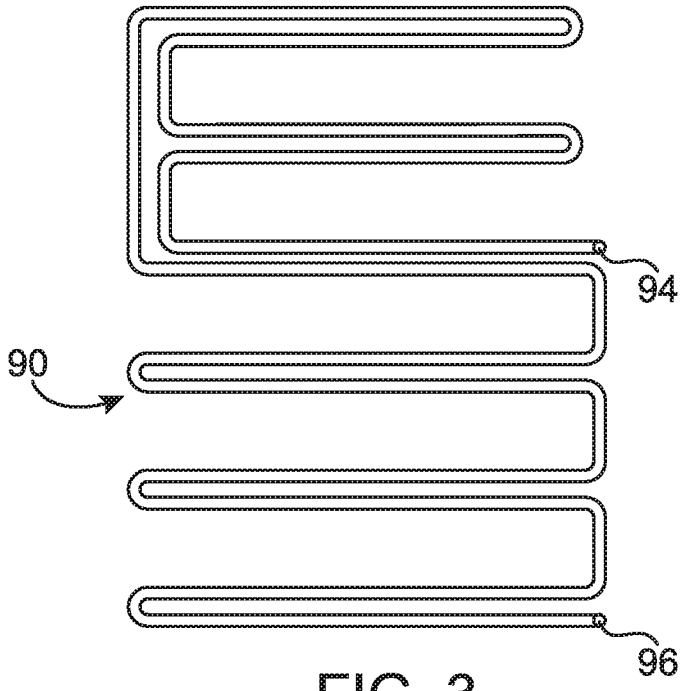
FIG. 3 is a schematic drawing of the first tubing for attachment to the freeze plate according to one embodiment of the present invention.
Figure 4:
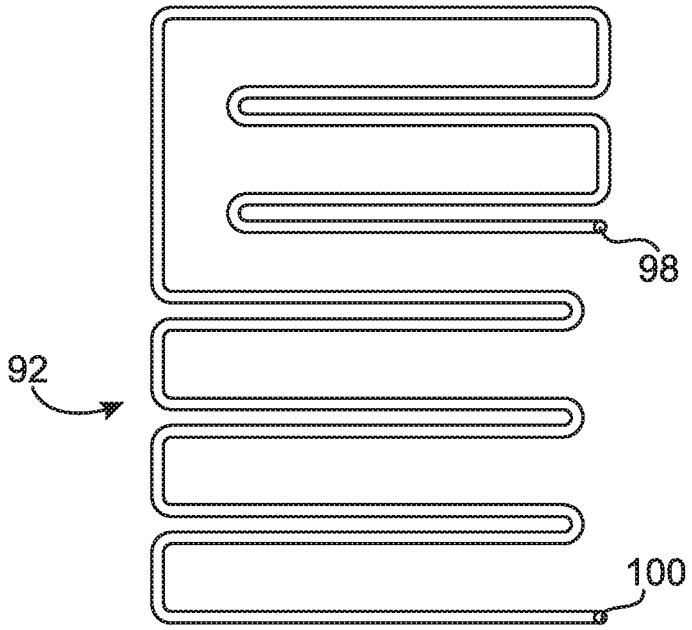
FIG. 4 is a schematic drawing of the second tubing for attachment to the freeze plate according to one embodiment of the present invention.

FIGS. 3 and 4 illustrate the first tubing 90 and second tubing 92 of evaporator assembly 32. The first tubing 90 has an inlet 94 connected to line suction 72 and an outlet 96 connected to suction line 76. Similarly, the second tubing 92 has an inlet 98 connected to line suction 74 and an outlet 100 connected to suction line 78. Thus, in each refrigeration circuit, the refrigerant cycles from the condenser to the compressor to the evaporator tubing 90 and 92.

Figure 5:
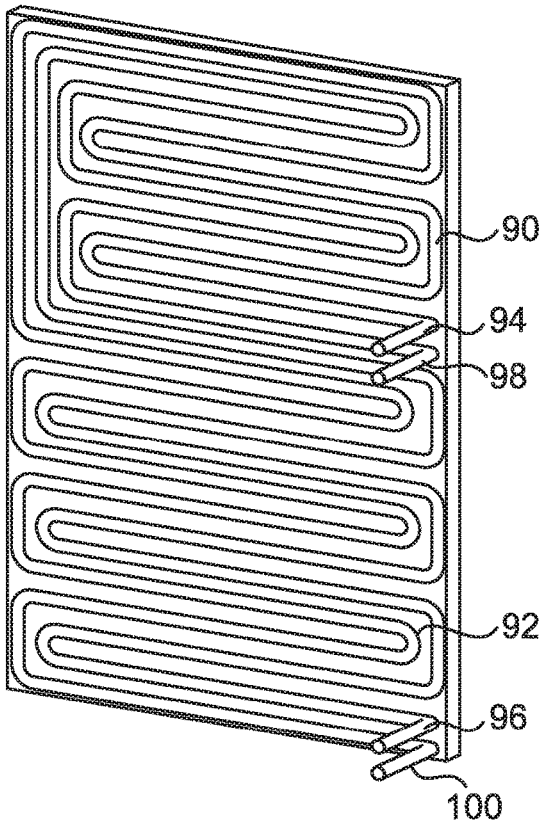
FIG. 5 is a schematic drawing of the front view of the evaporator assembly according to one embodiment of the present invention.
Figure 6:
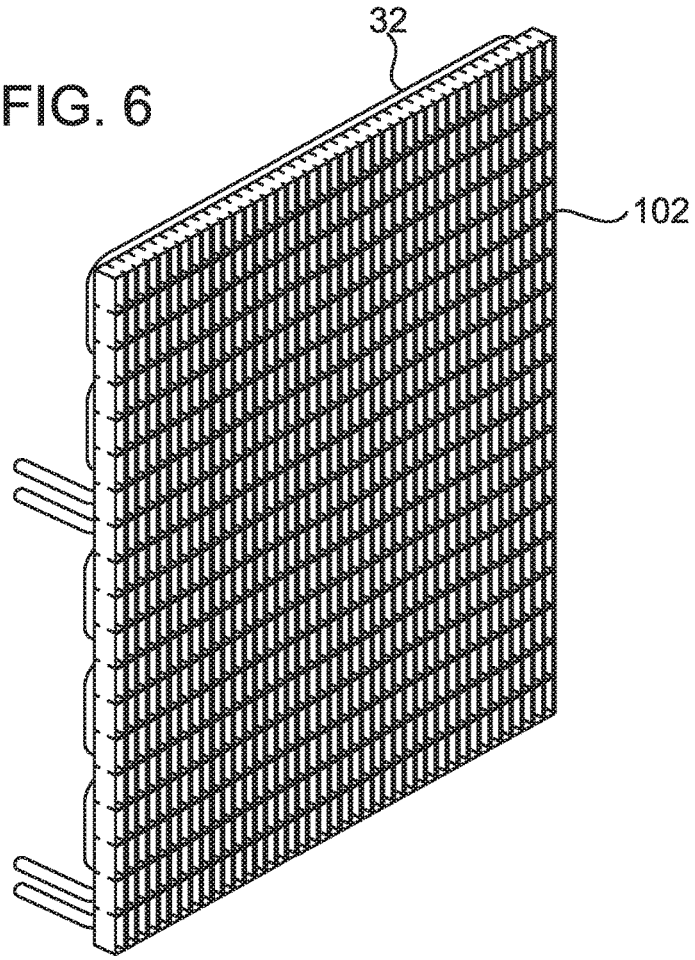
FIG. 6 is a schematic drawing of the rear view of the evaporator assembly according to one embodiment of the present invention.

FIG. 5 illustrates the first tubing 90 and the second tubing 92 thermally coupled to rear side of freeze plate 102 of the evaporator assembly 32. FIG. 6 shows the front view of the freeze plate 102 of evaporator assembly 32. The first tubing 90 and the second tubing 92 are preferably serpentine-shaped such that they may be interleaved with one another as illustrated in FIG. 5. Such an arrangement assists in ensuring a consistent temperature across the freeze plate 102, and thus, maximizing ice production by allowing for an even bridge thickness during ice making, while simultaneously minimizing the percentage of ice melt required to release the full batch during harvest. Using this arrangement, the refrigeration circuits 24 and 26 may each be charged at a level acceptable to meet the limitations of the IEC, while still providing a sufficiently high cooling capability to meet the needs of the commercial ice maker industry. Although the first and second tubing 90 and 92 depicted in FIG. 5 have a circular cross section and are arranged in a serpentine-like shape, other shapes are possible such that the combination of the two tubings are distributed over the freeze plate to provide substantially uniform cooling over the freeze plate.

Figure 7:
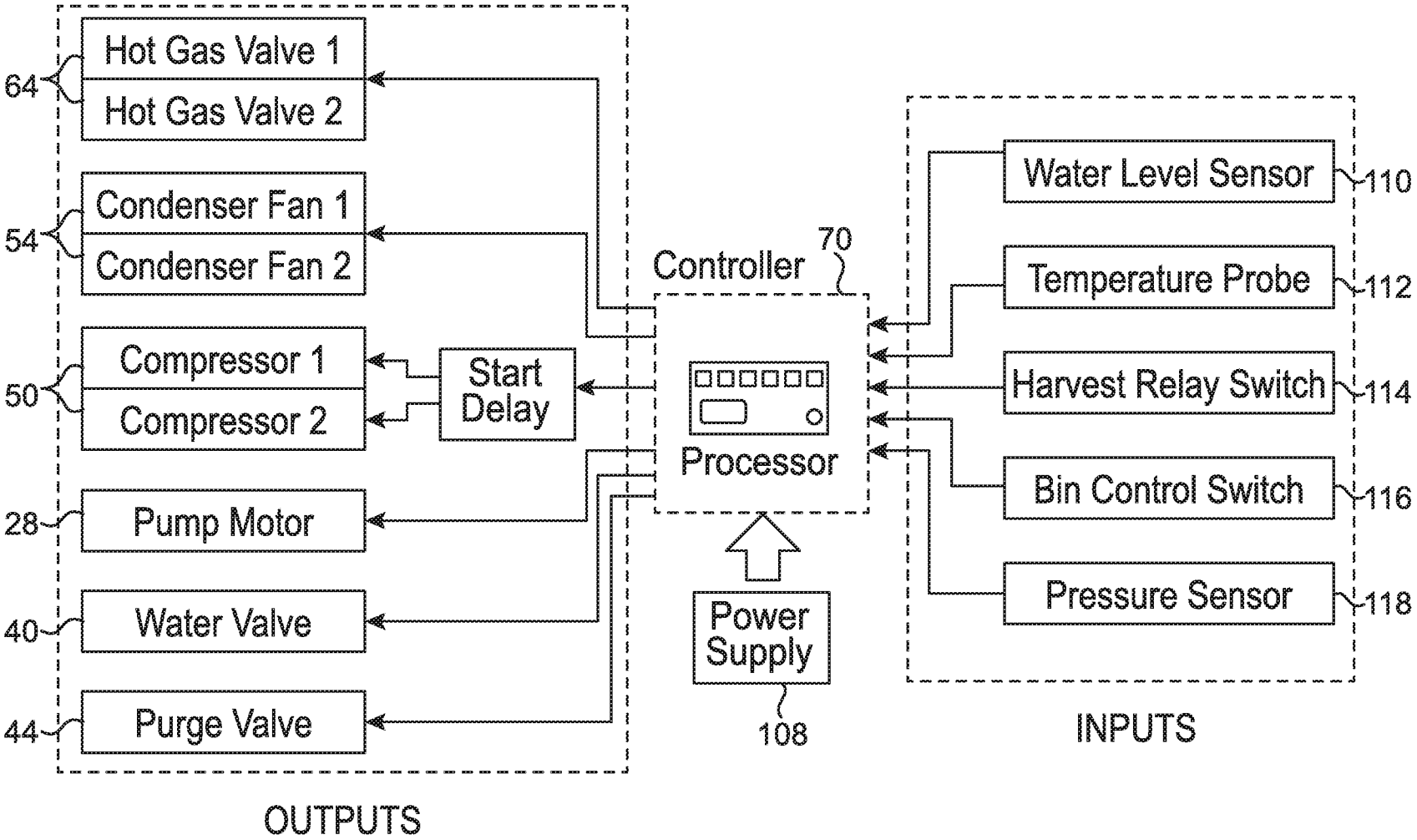
FIG. 7 is a diagram of the control system according to one embodiment of the present invention.

FIG. 7 illustrates the principal inputs and outputs to the controller 70 that may be included in one or more embodiments of the ice maker assembly 20. The inputs may include some combination of a water level sensor 110 measuring the level of the water the reservoir 26, a temperature probe 112 measuring the temperature near the evaporator assembly 32, a harvest relay switch 114 that is activated based on a certain amount of ice formed on the freeze plate, a bin control switch 116 that detects the fullness of the ice storage bin 14, and a pressure sensor 118 that may be used to detect the water pressure proximate the bottom of the reservoir 26, which can be correlated to the water level in reservoir 26.

The controller 70 issues signals to control the hot gas valve 64, condenser fan 54, and compressor 50 of each refrigeration circuit 24 and 26, and the circulation pump 28, water valve 40 and purge valve 44 of the water circuit 22. The controller 70 receives operating power through a conventional power supply 108.

Having described each of the individual components of embodiments of ice maker 10, including the ice making assembly 20, the manner in which the components interact and operate may now be described. Ice is produced by simultaneously running the refrigeration and water circulation systems. During a startup phase, it may be desirable not to start up both of the the compressors and condensers at the same time. During operation of ice making assembly 20 in a cooling cycle, comprising both a sensible cycle and a latent cycle, each compressor 50 receives low-pressure, substantially gaseous refrigerant from evaporator assembly 32 through suction lines 76 and 78, pressurizes the refrigerant, and discharges high-pressure, substantially gaseous refrigerant to condenser 52. In condenser 52, heat is removed from the refrigerant, causing the substantially gaseous refrigerant to condense into a substantially liquid refrigerant.

After exiting condenser 52, the high-pressure, substantially liquid refrigerant is routed through the drier 56, across the heat exchanger 58 and to the thermal expansion device 60, which reduces the pressure of the substantially liquid refrigerant for introduction into the first and second tubing 90 and 92 of the evaporator assembly 32 via lines 72 and 74 respectfully. As the low-pressure expanded refrigerant is passed through the first tubing 90 and the second tubing 92 of the evaporator assembly 32, the refrigerant absorbs heat from the tubes contained within evaporator assembly 32 and vaporizes as the refrigerant passes through the tubes thus cooling the freeze plate. Low-pressure, substantially gaseous refrigerant is discharged from the outlet of evaporator assembly 32 through line 74 and 78, passes across the heat exchanger 58, and is reintroduced into the inlet of compressor 50.

In certain embodiments, assuming that all of the components are working properly, at the start of the cooling cycle, water inlet valve 40 may be turned on to supply water to reservoir 26. After the desired level of water is supplied to reservoir 26, the water inlet valve 40 may be closed. Water pump 28 circulates the water from reservoir 26 to freeze plate 102 via distributor manifold or tube 30. Compressor 50 causes refrigerant to flow through the refrigeration system. The water that is supplied by water pump 28 then, during the sensible cooling cycle, begins to cool as it contacts freeze plate 30, returns to water reservoir 26 below freeze plate 102 and is recirculated by water pump 28 to freeze plate 102. Once the cooling cycle enters the latent cooling cycle, water flowing across freeze plate 102 starts forming ice cubes. As the volume of ice increases on the freeze plate 102, simultaneously the volume of water in the reservoir 26 decreases. The controller 70 may monitor either the amount of ice forming as measured by an ice thickness sensor, the decrease in the water in the reservoir 26 as measured by the water level sensor, or some other refrigeration system parameter to determine the desirable batch weight. Thus, the state of the freeze cycle may be calibrated to the water level in reservoir 26. Controller 70 can thus monitor the water level in reservoir 26 and can control the various components accordingly.

At that point, the harvesting portion of the cycle begins. The controller 70 opens the purge valve 42 to remove the remaining water and impurities from the reservoir 26. The water circuit 22 and the refrigeration circuits 24 and 26 are disabled. After the ice cubes are formed, hot gas valve 64 is opened allowing warm, high-pressure gas from compressor 50 to flow through a hot gas bypass line, through strainer 62 capable of removing particulates from the gas, check valve 80, and tee 68 to enter the tubing of the evaporator assembly 32, thereby harvesting the ice by warming freeze plate 102 to melt the formed ice to a degree such that the ice may be released from freeze plate 102 and fall into ice storage bin 14 where the ice can be temporarily stored and later retrieved. The hot gas valve 64 is then closed and the cooling cycle can repeat.

Several methods may be used to terminate the harvest cycle, each with the goal of improving the yield of ice produced and preventing the build-up of unharvested ice from cycle to cycle. One method is to monitor the evaporator outlet temperature, wait for it to reach some minimum value, and then incorporate time delay for safety. This indirect method of terminating harvest can prove unreliable over the life of the ice maker due to evaporator scaling from heavy sediment and minerals in the potable water supply. A more efficient method is to use a mechanical relay to trigger the end of a harvest, thereby eliminating wasted time. In one such case, the relay is attached to a horizontal flap beneath the evaporator assembly 32 and placed directly in the path of the sliding ice. As the ice slides away from the freeze plate 102, the relay is triggered and sends a signal to the controller 70 to immediately terminate the harvest. Upon harvest termination, the water supply valve 40 opens for a short time to refill the reservoir 26 with fresh water. The ice maker continues alternating freeze and harvest cycles until either the ice bin sensor is satisfied, the ice maker satisfies some programmed, preset schedule stored in the controller's memory, or the unit is shutdown either manually or automatically from some safety device or feature embedded within the controller.

Certain variations of the system described above are available. For example, the refrigeration circuits 24 and 26 may include single speed compressors 50 along with two thermostatic expansion valves 60 to maintain a superheat setting at the outlet of each individual circuit. Traditionally known methods for maintaining a balanced system by ensuring the proper charge of R-290 (or other hydrocarbon refrigerant) for each individual circuit may be used to by ensuring a consistent installation of the thermostatic element. Alternatively, the refrigeration circuits 24 and 26 may include two variable speed compressors 50 along with two electronic expansion valves 60 for maintaining a superheat setting at the outlet of each individual circuit. Still further, the refrigeration circuits may include sensing devices, such as Piezo-resistive Micro-Electro-Mechanical Systems (MEMS) technology, to determine the operating characteristics of each circuit and apply a frequency generating function to alter the speed of the compressors in an effort to balance the suction temperatures of the cooling loop, thereby, maintaining an even, more stable differential across the freeze plate. This same control according to the current embodiment could also modify other variable speed components, similar to those listed in U.S. patent application Ser. No. 14/591,650, incorporated herein by reference, to achieve the same stabilizing function.

The ice making assembly 20 may further include means for operation in the event of a failure of one of the two refrigeration circuits. With only one system operational, it is presumed that the ice making capacity would reduce in half, as would be the case for a traditional, dual ice making system. However, the cycle time may be extended in the event of a failure, thus providing a "fail-safe" by allowing ice making to continue until the system failure was addressed. The evaporator would continue to operate and scale proportionately to the actual run time of the system, and no additional or alternate cleaning schedule would need to be employed. The controller could further notify the end user through means of an external display that the ice maker was operating in said "fail-safe" mode. The ice making assembly may also include the ability to operate in a reduced capacity mode, wherein only one of the refrigeration circuits would be operational, and therefore, half of the ice capacity could be used during periods of low ice demands or in an effort to save energy consumption.

In yet another embodiment of the invention, the refrigeration circuits may use spiral tubed, water-cooled condensers in place of the traditional fin and tube air cooled condensers. Other alternatives include the use of brazed plate heat exchangers as the condensing apparatus. For all cases, the condensers could be employed either in tandem on separate circuits, or employed as a single heat exchanger with dual ports to further minimize the number of required components for the ice making assembly.

Thus, there has been shown and described novel apparatuses of an ice making machine that includes a refrigeration system designed for hydrocarbon refrigerants, and particularly propane (R-290), that includes dual independent refrigeration systems and a unique evaporator assembly having a single freeze plate attached to two cooling circuits. The evaporator assembly uses two serpentine-shaped tubing sections designed in an advantageous pattern that promotes efficiency by ensuring the even bridging of ice during freezing and minimizing unwanted melting during harvest by providing an even distribution of the heat load. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

The invention claimed is:

1. A method of harvesting ice from a single freeze plate of an ice maker, the method comprising adjusting a first hot gas valve and a separate second hot gas valve to direct first hot gas to flow along a first portion of the freeze plate and separate second hot gas to flow along a second portion of the freeze plate; and simultaneously heating the freeze plate using the first hot gas and the second hot gas.

2. A method as set forth in claim 1, wherein said adjusting the first hot gas valve directs the first hot gas to bypass a condenser of the ice maker.

3. A method as set forth in claim 2, wherein said adjusting the second hot gas valve directs the second hot gas to bypass a condenser of the ice maker.

4. A method as set forth in claim 1, wherein the first hot gas is directed along the first portion of the freeze plate through first tubing thermally coupled to the freeze plate.

5. A method as set forth in claim 4, wherein the second hot gas is directed along the second portion of the freeze plate through second tubing thermally coupled to the freeze plate.

6. A method as set forth in claim 5, wherein the first tubing extends along a first serpentine path along the freeze plate and the second tubing extends along a second serpentine path along the freeze plate.

7. A method as set forth in claim 6, wherein the first and second serpentine paths are interleaved.

8. A method as set forth in claim 6, wherein the first serpentine path and the second serpentine path are located in a common plane, the common plane being parallel to the freeze plate.

9. A method as set forth in claim 5, wherein each of the first and second tubings has a circular cross-sectional shape.

10. A method as set forth in claim 5, wherein each of the first and second tubings carries a charge of propane refrigerant of less than or equal to 150 grams.

11. A method as set forth in claim 1, further comprising activating a relay switch in response to forming the ice on the freeze plate during the ice making cycle.

12. A method as set forth in claim 11, wherein adjusting the first hot gas valve and the separate second hot gas valve is performed in response to said activating the relay switch.

* * * * *